United States Patent [19]

Yoo et al.

[11] 4,204,840

[45] May 27, 1980

[54] PROCESS FOR REMOVING SULFUR FROM COAL

[75] Inventors: Jin S. Yoo, South Holland; Emmett H. Burk, Jr., Glenwood; John A. Karch, Chicago, all of Ill.

[73] Assignee: Atlantic Richfield Company, Philadelphia, Pa.

[21] Appl. No.: 916,667

[22] Filed: Jun. 19, 1978

Related U.S. Application Data

[63] Continuation-in-part of Ser. No. 876,784, Feb. 10, 1978, which is a continuation-in-part of Ser. No. 690,477, May 27, 1976, abandoned.

[51] Int. Cl.[2] ..... C10L 9/10; C10B 57/00

[52] U.S. Cl. ..... 44/1 SR; 44/24; 201/17

[58] Field of Search ..... 44/1 R, 24; 201/17

[56] References Cited

U.S. PATENT DOCUMENTS

| | | | |
|---|---|---|---|
| 3,824,084 | 7/1974 | Dillon et al. | 44/1 R |
| 4,018,571 | 4/1977 | Cole et al. | 44/1 R |
| 4,054,420 | 10/1977 | Longanbach | 44/1 SR |
| 4,092,125 | 5/1978 | Stambaugh et al. | 44/1 SR |

*Primary Examiner*—Carl F. Dees

*Attorney, Agent, or Firm*—John B. Goodman

[57] ABSTRACT

A process for reducing the pyritic sulfur content of coal comprising the steps of:

(1) contacting an aqueous slurry of water, an alkaline earth metal base and pyrite-containing coal at elevated temperature with oxygen, said alkaline earth metal base being present in an amount at least equal to the stoichiometric amount of pyrite, and said aqueous slurry being maintained at a pH of from about 5.0 to about 12.0; and (2) recovering coal particles of reduced pyritic sulfur content.

18 Claims, No Drawings

PROCESS FOR REMOVING SULFUR FROM COAL

RELATED APPLICATIONS

This patent application is a continuation-in-part of patent application Ser. No. 876,784 filed Feb. 10, 1978, which is a continuation-in-part of patent application Ser. No. 690,477 filed May 27, 1976, now abandoned.

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes (substituted, terminal and sandwiched forms) chemically associated with the coal itself. Depending on the particular coal, the sulfur content can be primarily in the form of either inorganic sulfur or organic sulfur. Distribution between the two forms varies widely among various coals.

In the United States, except for Western coals, the bulk of the coal produced is known to be high in pyrite. Both Appalachian and Eastern interior coals have been analyzed to be rich in pyritic and organic sulfur. Generally the pyritic sulfur represents from about 25% to 70% of the total sulfur content in these coals.

Heretofore, it was recognized that it would be highly desirable to remove (or at least lower) the sulfur content of coal prior to combustion. A number of processes, for example, have been suggested for removing the inorganic (pyritic) sulfur from coal.

For example, it is known that at least some pyritic sulfur can be physically removed from coal by grinding the coal, and subjecting the ground coal to froth flotation or washing processes. While such processes can remove some pyritic sulfur, these processes are not fully satisfactory because a large portion of the pyritic sulfur is not removed. Attempts to increase the portion of pyritic sulfur removed have not been successful because these processes are not sufficiently selective. Because the process is not sufficiently selective, a large portion of coal can be discarded along with ash and pyrite.

There have also been suggestions heretofore to chemically remove sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3+FeS_2 \rightarrow 3FeCl_2+S$$

While this process is of interest, a disadvantage of this process is that the liberated sulfur solids must then be separated from the coal solids. Processes involving froth flotation, and vaporization are proposed to separate the sulfur solids. All of these proposals, however, inherently represent a second discrete process step with its attendant problems and cost which must be employed to remove the sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2+H_2O+7/2O_2 \rightarrow FeSO_4+H_2SO_4$$

$$2FeSO_4+H_2SO_4+1/2O_2 \rightarrow Fe_2(SO_4)_3+H_2O$$

These reaction equations indicate that in this particular process the pyritic sulfur content continues to be associated with the iron as sulfate. While it apparently does not always occur, a disadvantage of this is that insoluble material, basic ferric sulfate, can be formed. In addition, elemental sulfur which is also water soluble can be formed. When these materials are formed, a discrete separate separation procedure must be employed to remove this solid material from the coal solids to adequately reduce sulfur content. Several other factors detract from the desirability of this process. The oxidation of sulfur in the process does not proceed at a rapid rate, thereby limiting output for a given processing capacity. In addition, the oxidation process is not highly selective such that considerable amounts of coal itself can be oxidized. This is undesirable, of course, since the amount of coal recovered from the process is decreased.

In this prior art process, the water separated from the coal contains dissolved acidic sulfur compounds, for example, sulfuric acid. This water is not acceptable for disposal and must be treated, for example, with lime, to remove the dissolved sulfur compounds. This is a disadvantage in that this treatment represents a further process step.

SUMMARY OF THE INVENTION

This invention provides a practical method for more effectively reducing the sulfur content of coal. In its broad aspect, this invention presents a process for reducing the pyritic sulfur content of coal comprising the steps of:

(1) contacting an aqueous slurry of water, an alkaline earth metal base and pyrite-containing coal at elevated temperature with oxygen, said alkaline earth metal base being present in an amount at least equal to the stoichiometric amount of pyrite, and said aqueous slurry being maintained at a pH of from about 5.0 to about 12.0; and (2) recovering coal particles of reduced pyritic sulfur content.

A particularly important aspect of this invention is that the aqueous slurry is maintained at a pH in the range of from about 5.5 to 12.0 during the process. It has been discovered that maintaining the pH in this range provides faster reaction rates (reducing processing time), more selective oxidation of sulfur compounds, and some organic sulfur removal. It has also been discovered that maintaining this pH range can substantially reduce elemental sulfur formation.

Another aspect of this invention is that dissolved acidic sulfur compounds react with alkaline earth metal base during the process forming insoluble compounds more acceptable for disposal. These desirable attributes are important, and are made available in the process of this invention.

DETAILED DESCRIPTION OF THE INVENTION AND ITS PREFERRED EMBODIMENTS

This invention provides a method for reducing the pyritic sulfur content of coal by a process comprising the steps of:

(1) contacting an aqueous slurry of water, an alkaline earth metal base and pyrite-containing coal at elevated temperature with oxygen, said alkaline earth metal base being present in an amount at least equal to the stoichiometric amount of pyrite, and said aqueous slurry being maintained at a pH of from about 5.0 to about 12.0; and (2) recovering coal particles of reduced pyritic sulfur content.

The novel process of this invention is especially effective for reducing the pyritic sulfur content of coal. An advantage of the process is that it can also provide a reduction in the organic sulfur content of some coals.

Suitable coals which can be employed in the process of this invention include brown coal, lignite, subbituminous, bituminous (high volatile, medium volatile, and low volatile), semi-anthracite, and anthracite. Regardless of the rank of feed coal, excellent pyrite removal can be achieved by the process of this invention.

The coal employed in this invention is most suitably in the form of particles, or particles of coal agglomerated with oil into coal-oil agglomerates.

Coal particles can be provided by a variety of known processes, for example, grinding. The particle size of the coal can vary over wide ranges and in general the particles need only be sufficiently small to enhance contacting with the aqueous medium. For instance, the coal may have an average particle size of one-fourth inch in diameter or larger in some instances, and as small as minus 200 mesh (U.S. Screen) or smaller. The most practical particle size is often minus 5 mesh, preferable minus 18 mesh, as less energy is required for grinding and yet the particles are sufficiently small to achieve an optimum rate of pyrite removal.

Coal-oil agglomerates are most suitably formed from coal particles as small as minus 200 mesh or smaller and more generally minus 80 mesh. Such agglomerates can be formed by agitating a water slurry of coal particles with from about 5% to 60%, preferably 5% to 30%, and more preferably 5% to 15%, by weight of coal, of hydrocarbon oil.

Coal-oil agglomerates are most suitably formed by adding hydrocarbon oil to an aqueous slurry of coal particles and agitating the slury.

Suitable hydrocarbon oils for forming coal-oil agglomerates are derived from pertroleum, shale oil, tar sand and coal. Suitable hydrocarbon oils include light and heavy refined petroleum fractions, for example, light cycle oil, vacuum gas oil, residual oil, coal tar and solvent refined coal oil. Mixtures of the various hydrocarbon oils can also be employed, particularly when one of the materials is very viscous.

The most suitable hydrocarbon oils are light cycle oil, heavy cycle oil, heavy gas oil, coker oil and residual oil.

The hydrocarbon oils are hydrophobic and will wet the coal particles. When an aqueous slurry of coal particles is contacted with the hydrocarbon oil and agitated, the hydrocarbon wet coal particles collide with one another forming agglomerates. In general the size of the coal-oil agglomerate is at least about 2 to 3 times the average size of the coal particles which make up the coal-oil agglomerates.

Agitating the mixture can be suitably accomplished using stirred tanks or other apparatus. An apparatus which provides a zone of shearing agitation is preferred for agitating the mixture.

The term "coal particulates" will be employed hereinafter from time to time to refer to coal particles and/or coal-oil agglomerates.

In the process of this invention an aqueous slurry of water and coal particulates is contacted at elevated temperatures with oxygen. The aqueous slurry of water and coal can be formed, for example, by grinding coal in the presence of water or water can be added to coal particles of a suitable size. Preferably, the aqueous slurry contains from about 5 to about 50%, by weight, coal particulates and more preferably from about 10 to about 30%, by weight, coal particulates and the balance water.

This aqueous slurry of coal is contacted, in a suitable vessel, for example, an autoclave, at elevated temperatures in the presence of oxygen, preferably at pressures above atmospheric, such that pyritic sulfur is preferentially oxidized without significant adverse oxidation of the coal substrate. For example, temperatures of from about 150° to 350° F., more preferably from about 175° to about 270° F. can be suitably employed. The oxygen can be present as pure oxygen gas or it can be mixed with other inert gases. For example, air or air enriched with oxygen can be suitably employed as a source of gaseous oxygen. Preferably, the gaseous oxygen is above atmospheric pressure, for example, pressures of from about 50 to 500 psig., and more preferably from about 100 to 400 psig. If the oxygen is mixed with other gases, the partial pressure of oxygen is most suitably within the pressure ranges mentioned hereinbefore.

Under these conditions, the oxygen gas and water readily remove pyritic sulfur from the coal. This removal involves oxidation of the pyritic sulfur to sulfate, thionate and thio sulfate forms. As the reaction proceeds, oxygen is consumed. Additional oxygen can be added to the system to maintain a constant partial pressure of oxygen.

The feed coal should be held under these conditions for a period of time sufficient to effect a significant reduction in the pyritic sulfur content, i.e., a reduction of 50%, and more preferably, a reduction of from 70% to 95% or more, by weight, of pyritic sulfur. Generally, a time period in the range of from about 5 minutes to 2 hours can be satisfactorily employed. Preferably, a time period of from 10 minutes to 1 hour is employed. During this time, it can be desirable to agitate the aqueous slurry of coal and water. Known mechanical mixers, for example, can be employed to agitate the slurry.

When coal containing pyritic sulfur is held under these reaction conditions, the pH of the aqueous slurry falls since sulfuric acid is formed in the reaction as pyrite is oxidized. This invention contemplates a process involving removing an amount of pyrite from coal such that without the presence of base material the pH would fall below about 5.0. This is a condition which would generally occur if meaningful pyrite reduction is obtained. In such a situation, the final pH can be quite low, for example, the pH of the reaction slurry can fall to a pH of from about 1 to 3, or less. It has been found that if the pH of the aqueous slurry is maintained at from about 5.0 to about 12.0, preferably 5.5 to 12.0, and most preferably from about 6.5 to about 10.0 that certain very distinct advantages are obtained. (As used herein, "maintain" means keeping the pH within required limits for at least a period of time sufficient to substantially obtain the advantages of the invention, i.e., a significant reduction in pyritic sulfur.) As noted hereinbefore, these advantages include faster reaction rates, more selective oxidation and reduced formation of elemental sulfur.

A pH of from about b 5.0 to about 12.0 during the course of the reaction is preferably maintained by employing an amount of alkaline earth metal base material in excess of the stoichiometric amount of pyrite in the coal. Preferably, the amount of alkaline earth metal base material employed is from about 1.5 to 3 times to the stoichiometric amount of pyrite. Examples of alkaline earth metal bases include calcium hydroxide, lime, limestone, magnesium oxide, magnesium carbonate and dolomite. The preferred alkaline earth metal bases materials are the calcium bases, for example, calcium hydroxide, lime and limestone. The most preferred base material is limestone.

While an excess of alkaline earth base material is preferred for maintaining the pH, it is with the scope of the invention to employ other base materials in addition to alkaline earth metal base material to maintain desired pH. Examples of other base materials are alkali metal bases, for example, sodium hydroxide, potassium hydroxide, and their corresponding oxides, sodium carbonate, sodium, bicarbonate, potassium bicarbonate. Ammonia, ammonium bicarbonate and ammonium carbonate are additional examples of other suitable base materials.

It will be recognized by those skilled in the art that there are many ways to maintain the pH of the aqueous slurry within the desired range. For example, the pH of slurry can be continuously monitored using commercially available pH meters, and a suitable quantity of basic material can be metered to the slurry as needed to maintain the desired pH. Another suitable method for maintaining the pH in the desired range involves adding an appropriate amount of basic material to the aqueous slurry of coal and water prior to subjecting the slurry to the reaction conditions involving increased temperature and pressure.

The process of this invention requires at least a stoichiometric amount of alkaline earth metal base material. Such a base material not only acts to maintain the desired pH of the aqueous coal slurry, but it also forms insoluble salts with the sulfur species removed from the coal in the course of the reaction. Heretofore it was assumed that these water insoluble salts would be difficult or impossible to separate from the coal particulates. It has been discovered that this is not the case. Therefore, it the amount of base material present is at least equal to the stoichiometric amount of pyrite the desirable result is that water soluble sulfur species removed from coal in the process are converted to water separable insoluble solids. This is in contrast to prior suggested practice wherein process water containing soluble sulfur species removed from coal was separated from the coal; and, the process water was subjected to a separate step (generally involving addition of lime, etc. to form insoluble solids) to separate the environmentally unacceptable acidic sulfur compounds from the process water.

After holding the aqueous slurry of coal particles and alkaline earth metal base material under the reaction conditions of the process, the pyritic sulfur in the coal is substantially oxidized to water separable compounds which are predominately water insoluble salts, for example, water insoluble sulfate salts.

Water containing the insoluble sulfur salts is separated from the coal particulates. Such a separation is conveniently made using bar sieves or screens. For example, screens which are sized to retain the coal particles, and pass water and very small insoluble alkaline earth metal sulfur salts.

If very fine coal particles were employed in the process, e.g., minus 60 mesh, this separation can be aided by agglomerating the particles with oil in the manner mentioned hereinbefore. Suprisingly, such an agglomeration does not occlude the insoluble sulfur salts. The resulting separated particulates have a substantially reduced pyritic sulfur content and can exhibit a diminished organic sulfur content.

As noted hereinbefore, coal-oil agglomerates are employed in preferred embodiments of the invention.

The recovered coal-oil agglomerates are coal-oil agglomerates wherein the coal portion is significantly reduced in sulfur content and ash content. These coal-oil agglomerates are an excellent low sulfur, low ash fuel and can be used as such.

If desired the oil can be removed from these coal-oil agglomerates to provide coal particles reduced in sulfur and/or ash content. A variety of methods can be employed to remove the hydrocarbon oil from the coal-oil agglomerates. For example, agglomerates can be washed with an organic fluid, for example, hexane or toluene, in which the hydrocarbon oil is soluble, and separating the resulting solution from the coal particles.

Generally, it will be desirable to separate the insoluble sulfur salts, for example, gypsum, from the process water. This can be accomplished in a number of ways. For example, the process water containing the insoluble sulfur solids can be placed in settling ponds, and the salts allowed to precipitate from the water. A variety of alternative methods of course could be employed.

The following examples are provided to better illustrate the invention by presenting several specific embodiments.

EXAMPLE I

Upper Freeport, Kingwood Mine coal was ground and screened to provide a quantity of feed coal having a particle size of less than 80 mesh. This feed coal was analyzed to determine its sulfur content and type.

Sixteen parts, by weight, of this feed coal was slurried with 84 parts, by weight, water and a quantity of limestone were placed in an autoclave. The quantity of limestone was such that the initial pH was 7.80 and the final pH was 5.75. This quantity of limestone amounted to approximately 1.5 times the stoichiometric amount of pyrite in the coal. The autoclave was sealed and heated to 300° F. Oxygen was then introduced, and maintained at 300 psig. The coal was held under these conditions for one hour. The autoclave was then cooled.

The contents of the autoclave were transferred to a beaker equipped with baffles and a stirrer. One hundred parts of water were added to the beaker. Stirring was commenced, and light cycle oil was slowly added to the beaker. In the course of the addition of the light cycle oil, the coal particles began to agglomerate. The amount of light cycle oil added was 15%, by weight, of coal.

The contents of the beaker were then emptied onto a 40 mesh screen; substantially all of the coal agglomerates were retained on the screen. Finely divided gypsum solids formed by the reaction of limestone and sulfur products removed from the coal did not agglomerate with the coal and passed the screen with the water. The coal agglomerates were washed several times with fresh water.

The resulting agglomerates were then dried, de-oiled and analyzed.

The results obtained are shown in Table I. In Table I, the sulfur and ash content, and the sulfur content by sulfur type are presented for the feed and coal after treatment. All results are on a dry, ash-free basis.

It is notable in Table I that significant sulfur reduction is achieved by the process of the invention presented. It is also especially notable that very significant ash reduction can be obtained. The significant ash reduction obtained in the process disclosed herein is an important aspect of the process of this invention as ash concentration can effect the combustion characteristics of coal.

TABLE I

| | % Ash | % Total Sulfur | % Sulfur Type | | |
|---|---|---|---|---|---|
| | | | Sulfate | Pyrite | Organic |
| Feed Coal | 12.7 | 3.30 | 0.32 | 1.96 | 1.02 |
| Treated Coal | 7.98 | 1.29 | 0.01 | 0.45 | 0.83 |

EXAMPLE II

Upper Freeport, Kingwood Mine coal was ground and screened to provide a quantity of coal having a particle size of less than 80 mesh.

One part, by weight, of this coal and 10 parts, by weight, water were added to a beaker equipped with an electric stirrer. The stirrer was activated, and 15%, by weight of coal, of light cycle oil was added to the beaker. When the light cycle oil was added, the coal particles began to agglomerate, forming coal-oil agglomerates. Stirring was continued until agglomeration was essentially complete. The contents of the beaker were then poured onto a 40 mesh screen to recover the coal-oil agglomerates. The coal-oil agglomerates were washed with water.

One part by weight coal-oil agglomerates and 4 parts by weight water were slurried together and added to an autoclave. A quantity of limestone was added to the autoclave to provide an initial pH of 8.30 and a final pH of 5.75. This quantity of limestone amounted to approximately 1.5 times the stoichiometric amount of pyrite in the coal. The autoclave was sealed and heated to 300° F. Oxygen was then introduced, and maintained at 300 psig. The coal was held under these conditions for one hour. The autoclave was then cooled, and the contents poured onto a 40 mesh screen to separate the coal-oil agglomerates and water. Insoluble sulfur compounds, for example, gypsum formed by reaction with limestone passed the screen with the water.

The coal-oil agglomerates were de-oiled by washing the coal-oil agglomerates with a hydorcarbon oil solvent (toluene and hexane) to remove the hydrocarbon oil and recover a coal produce of reduced sulfur content.

The sulfur content of the feed coal before treatment, and the sulfur content of the coal after treatment are shown in Table II below.

TABLE II

| | Total Sulfur | Sulfur Type (% Coal) | | | % Ash | *DAF |
|---|---|---|---|---|---|---|
| | | Sulfate | Pyritic | Organic | | |
| Feed Coal | 3.30 | 0.32 | 1.96 | 1.02 | 12.7 | |
| Treated Coal | 1.09 | 0.03 | 0.47 | 0.79 | 11.2 | |

*Dry Ash Free Basis

Analysis of oil separated from the de-oiled coal-oil agglomerates indicated little or no sulfur uptake from the coal. The treated coal-oil agglomerates formed in this example are reduced in sulfur and ash content and can be very suitably employed as an improved low sulfur, low ash fuel.

In the above examples the agglomerates were de-oiled in order to better illustrate the effectiveness of the process of the invention in reducing sulfur and ash in coal. The resulting coal-oil agglomerates, however, are an excellent fuel exhibiting reduced sulfur and ash contents and can be used as such or in blends with other coals.

It is also noteworthy that the process of the invention provides for enhanced BTU recoveries of coal often in excess of 90% even up to in excess of 95%.

While this invention has been described with respect to various specific examples and embodiments, it is to be understood that the invention is not limited thereto and that it can be variously practiced within the scope of the following claims.

What is claimed is:

1. A process for reducing the pyritic sulfur content of coal comprising the steps of:

(1) contacting an aqueous slurry of water, an alkaline earth metal base and pyrite-containing coal at elevated temperature with oxygen, said alkaline earth metal base being present in an amount at least equal to the stoichiometric amount of pyrite, and said aqueous slurry being maintained at a pH of from about 5.0 to about 12.0; and (2) recovering coal particles of reduced pyritic sulfur content.

2. The process of claim 1 wherein the pH is from about 6.5 to 10.

3. The process of claim 1 wherein the temperature is from about 150° F. to about 350° F.

4. The process of claim 1 wherein the oxygen is at a pressure of from about 50 to 500 psig.

5. The process of claim 1 wherein the alkaline earth metal base is selected from the group consisting of calcium hydroxide, lime, limestone, magnesium oxide, magnesium carbonate, dolomite and mixtures thereof.

6. The process of claim 5 wherein the alkaline earth metal base is limestone.

7. The process of claim 1 wherein the coal contacted at elevated temperature with oxygen is agglomerated with hydrocarbon oil.

8. The process of claim 1 wherein the aqueous slurry contains from about 5 to 50%, by weight, coal.

9. The process of claim 5 wherein the aqueous slurry of water and coal particles contains from about 10 to 30%, by weight, coal particles.

10. A process for reducing the sulfur content of coal comprising the steps of:

(1) contacting an aqueous slurry of water, an alkaline earth metal base and pyrite-containing coal particles at elevated temperature with oxygen, said alkaline earth metal base being present in an amount at least equal to the stoichiometric amount of pyrite, and said aqueous slurry being maintained at a pH of from 5.5 to 12.0; and (2) contacting the slurry of coal particles with hydrocarbon oil to form coal-oil agglomerates; and (3) recovering coal-oil agglomerates wherein the coal has reduced sulfur content.

11. The process of claim 10 wherein the temperature is from about 150° F. to about 350° F.

12. The process of claim 11 wherein the oxygen is at a pressure of from about 50 to 500 psig.

13. The process of claim 10 wherein the pH is maintained at 6.5 to 10.0 by adding an alkali material to the aqueous slurry.

14. The process of claim 10 wherein the alkaline earth metal base is selected from the group consisting of calcium hydroxide, lime, limestone, magnesium oxide, magnesium carbonate, dolomites and mixtures thereof.

15. The process of claim 14 wherein the alkaline earth metal base is limestone.

16. The process of claim 10 wherein the aqueous slurry of water and coal particles contains from about 5 to 50%, by weight, coal particles.

17. The process of claim 11 wherein the aqueous slurry of water and coal particles contains from about 10 to 30%, by weight, coal particles.

18. The process of claim 10 wherein the hydrocarbon oil is removed from the recovered coal-oil agglomerates to recover coal of reduced sulfur content.

* * * * *